US012618181B2

(12) United States Patent
Phelps et al.

(10) Patent No.: US 12,618,181 B2
(45) Date of Patent: May 5, 2026

(54) CALIBRATION CYCLES IN WASHING MACHINE APPLIANCES

(71) Applicant: Haier US Appliance Solutions, Inc., Wilmington, DE (US)

(72) Inventors: Stannard Nathan Phelps, Louisville, KY (US); Stephen Edward Hettinger, Louisville, KY (US); Nicholas Dillon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 221 days.

(21) Appl. No.: 18/477,971

(22) Filed: Sep. 29, 2023

(65) Prior Publication Data

US 2025/0109539 A1 Apr. 3, 2025

(51) Int. Cl.

| | |
|---|---|
| ***D06F 33/30*** | (2020.01) |
| ***D06F 34/08*** | (2020.01) |
| ***D06F 101/20*** | (2020.01) |
| ***D06F 103/02*** | (2020.01) |
| ***D06F 103/32*** | (2020.01) |
| ***D06F 103/44*** | (2020.01) |
| ***D06F 103/68*** | (2020.01) |
| ***D06F 105/52*** | (2020.01) |

(52) U.S. Cl.

CPC ..... *D06F 33/30* (2020.02); *D06F 34/08* (2020.02); *D06F 2101/20* (2020.02); *D06F 2103/02* (2020.02); *D06F 2103/32* (2020.02); *D06F 2103/44* (2020.02); *D06F 2103/68* (2020.02); *D06F 2105/52* (2020.02)

(58) Field of Classification Search

CPC ..... D06F 33/30; D06F 34/08; D06F 2101/20; D06F 2103/02; D06F 2103/32; D06F 2103/44; D06F 2105/52; D06F 2103/68

See application file for complete search history.

(56) References Cited

U.S. PATENT DOCUMENTS 7,168,118 B2 1/2007 Kim et al.
9,212,444 B2 12/2015 Griswold et al.
(Continued)

FOREIGN PATENT DOCUMENTS

DE 102018101374 A1 * 7/2019 ..... D06F 33/00
EP 3059342 A1 * 8/2016 ..... D06F 58/50
(Continued)

OTHER PUBLICATIONS

DE102018101374 translation (Year: 2019).*

*Primary Examiner* — Michael E Barr
*Assistant Examiner* — Lauren G Orta
(74) *Attorney, Agent, or Firm* — Dority & Manning, P.A.

(57) ABSTRACT

A method for a dry cycle calibration in a washing machine appliance. The method includes receiving an activation signal of a calibration cycle, performing, the calibration cycle in response to the activation signal. The calibration cycle including analyzing a cycle history of the washing machine appliance, measuring a first line voltage of an electrical supply line, monitoring a temperature via a temperature sensor of the washing machine appliance, measuring a load inertia and a second line voltage of the electrical supply line, and updating operational parameters in response to one or more of a line stiffness between the first line voltage and the second line voltage, the load inertia, and the temperature.

18 Claims, 6 Drawing Sheets

(56) References Cited

U.S. PATENT DOCUMENTS

| | | | | |
|---|---|---|---|---|
| 2009/0272003 | A1 | 11/2009 | Dalton et al. | |
| 2011/0016640 | A1* | 1/2011 | Kim | D06F 33/47 68/12.02 |
| 2011/0247148 | A1* | 10/2011 | Chanda | D06F 34/18 68/12.16 |
| 2012/0060299 | A1* | 3/2012 | Kim | D06F 34/18 68/12.04 |
| 2013/0055770 | A1 | 3/2013 | Kim et al. | |
| 2017/0145614 | A1* | 5/2017 | Janke | D06F 33/48 |
| 2019/0106827 | A1* | 4/2019 | Heo | H02H 3/08 |

FOREIGN PATENT DOCUMENTS

| | | | |
|---|---|---|---|
| EP | 3059342 | B1 | 11/2022 |
| JP | 3471176 | B2 | 11/2003 |

* cited by examiner

CALIBRATION CYCLES IN WASHING MACHINE APPLIANCES

FIELD OF THE INVENTION

The present subject matter relates generally to calibration cycles in washing machine appliances.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element may rotate at various speeds to agitate articles within the wash chamber, to wring wash fluid from articles within the wash chamber, etc.

Washing machine appliances may operate in numerous cycles. For example, the typical washing machine appliance may be operable in various wash cycles, rinse cycles, drain cycles, and spin cycles. In the wash cycle, the wash fluid is directed into the wash tub and onto articles within the wash chamber of the basket. The rinse cycle includes rinsing the articles in the wash tub, e.g., with fresh water. The drain cycle is used in between different cycles to remove, e.g., drain, the wash fluid from the wash tub. In each of the cycles, fluid may be present in the tub of the washing machine appliance, and proper operation of the washing machine may rely upon accurately detecting qualities of the fluid in the tub, such as pressure and temperature.

Accordingly, washing machine appliances may include one or more fluid sensors, such as temperature sensors, and/or pressure sensors, etc. Inaccurate readings from the sensor(s) may result in undesirable or inefficient operation of the washing machine appliance based on the inaccurate sensor readings.

Accordingly, systems and methods for improved calibration, e.g., of washing machine appliance sensors and readings produced by such sensors is desired in the art.

BRIEF DESCRIPTION OF THE INVENTION

Aspects and advantages of the invention will be set forth in part in the following description, or may be apparent from the description, or may be learned through practice of the invention.

In one example embodiment, a method for a dry cycle calibration in a washing machine appliance. The washing machine appliance includes a tub, a basket within the tub, a motor coupled to the basket, the motor operable to rotate the basket within the tub, an electrical supply line in electrical communication with the motor, a temperature sensor positioned at the tub, and a controller in operative communication with the motor, the electrical supply line, and the temperature sensor. The method includes receiving, at a controller, an activation signal of a calibration cycle, and performing the calibration cycle in response to the activation signal. The calibration cycle includes analyzing, by the controller, a cycle history of the washing machine appliance, measuring, by the controller, a first line voltage of an electrical supply line, monitoring, by the controller, a temperature via a temperature sensor of the washing machine appliance, measuring, by the controller, a load inertia and a second line voltage of the electrical supply line, updating, by the controller, operational parameters in response to one or more of a line stiffness between the first line voltage and the second line voltage, the load inertia, and the temperature.

In another example embodiment, a washing machine appliance includes a tub, a basket within the tub, and a motor coupled to the basket. The motor is operable to rotate the basket within the tub. The washing machine appliance also includes an electrical supply line in electrical communication with the motor, a temperature sensor positioned at the tub, and a controller in operative communication with the motor, the electrical supply line, and the temperature sensor. The controller is configured to receive an activation signal of a calibration cycle. The calibration cycle includes the controller configured to analyze a cycle history of the washing machine appliance, measure a first line voltage of an electrical supply line, monitor a temperature via the temperature sensor of the washing machine appliance, measure a load inertia and a second line voltage of the electrical supply line, and update operational parameters in response to one or more of a line stiffness between the first line voltage and the second line voltage, the load inertia, and the temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
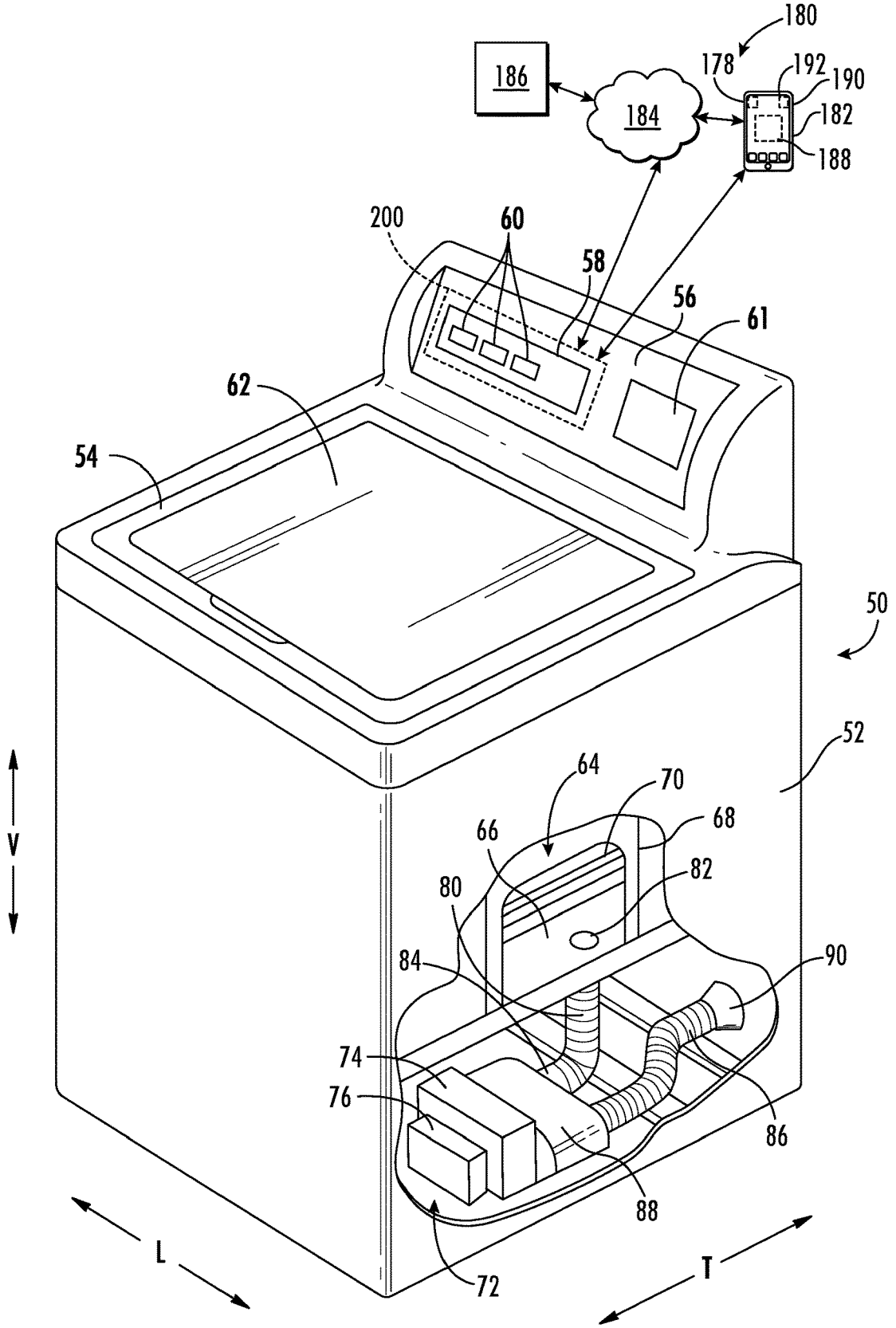
FIG. 1 is a perspective view of a washing machine appliance according to an example embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment may be used with another embodiment to yield a still further embodiment. Thus, it is intended that the present invention covers such modifications and variations as come within the scope of the appended claims and their equivalents.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

FIG. 1 provides a perspective view of a washing machine appliance 50 with a partially removed layer according to an example embodiment of the present subject matter. As may be seen in FIG. 1, washing machine appliance 50 defines a vertical direction V, a lateral direction L and a transverse direction T. The vertical direction V, lateral direction L and transverse direction T are mutually perpendicular and form an orthogonal direction system.

Washing machine appliance 50 may generally include a cabinet or apron 52 and a top panel or cover 54. A backsplash 56 may extend from cover 54, and a control panel 58 including a plurality of input selectors 60 may be coupled to backsplash 56. Control panel 58 and input selectors 60 may collectively form a user interface input for operator selection of machine cycles and features, and in one embodiment a display 61 may indicate selected features, a countdown timer, and/or other items of interest to machine users. A lid 62 may mounted to cover 54 and is rotatable about a hinge (not shown) between an open position (not shown) facilitating access to a wash tub 64 located within apron 52, and a closed position (shown in FIG. 1) forming a sealed enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

A sub-washer unit 65 (FIG. 2) is mounted within apron 52. Sub-washer unit 65 includes tub 64 and a basket 70. Tub 64 includes a bottom wall 66 and a cylindrical side wall 68, and basket 70 is rotatably mounted within wash tub 64. Bottom wall 66 of tub 64 is spaced, e.g., vertically, from an open top end of cylindrical side wall 68. A pump assembly 72, such as a drain pump assembly, is located beneath tub 64 and basket 70 for gravity assisted flow when draining tub 64. Pump assembly 72 includes a pump 74, such as a drain pump, and a motor 76. A pump inlet hose 80 extends from a wash tub outlet 82 in tub bottom wall 66 to a pump inlet 84, and a drain hose 86 extends from a pump outlet 88 and ultimately to a building plumbing system discharge line (not shown) in flow communication with drain hose 86.

Figure 3:
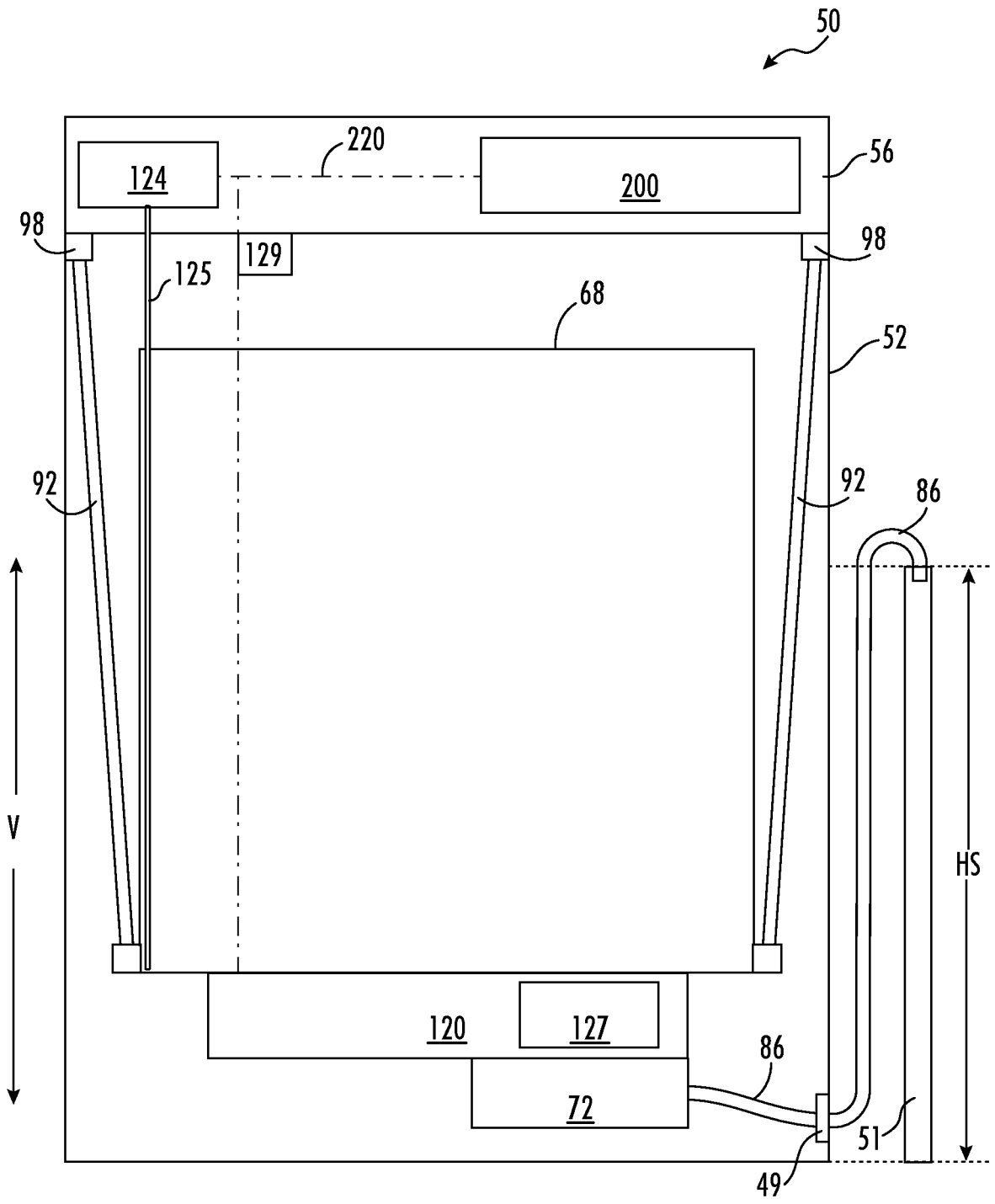
FIG. 3 is a schematic view of certain components of the example washing machine appliance of FIG. 1.

As shown in FIG. 3, pump assembly 72 may be mounted to tub 64 in alternative example embodiments. In particular, pump assembly 72 may be mounted directly to the bottom side of sub-washer unit 65. Wash fluid may drain under gravity from tub 64 or may be pumped out of appliance 50 via pump assembly 72. The displaced wash fluid passes through drain hose 86, which may have a discharge end attached to a rear panel mounted bracket 49, during operation of pump assembly 72.

Figure 2:
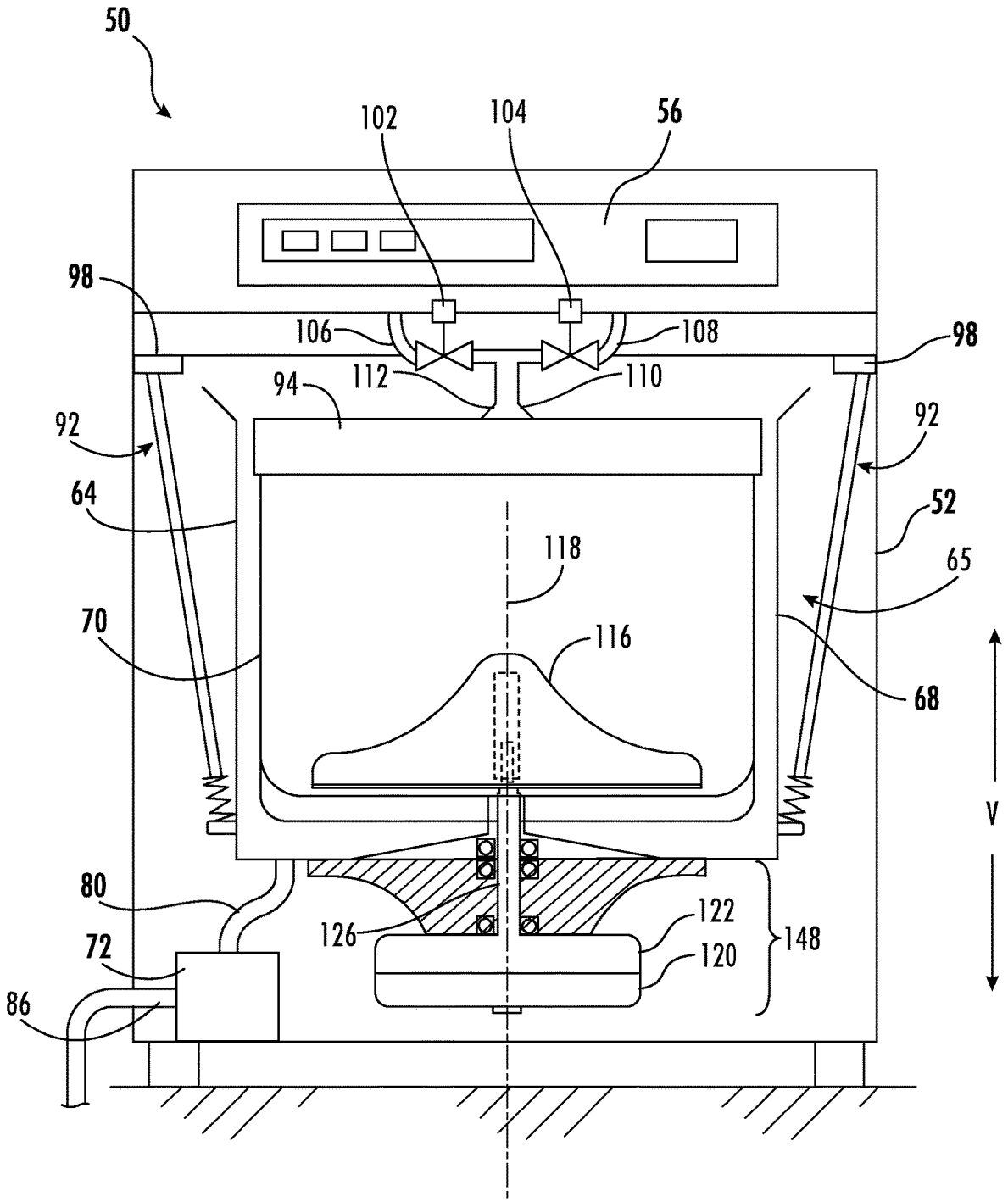
FIG. 2 is a section view of the example washing machine appliance of FIG. 1.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2) may also be provided to produce a wash solution by mixing fresh water with a known detergent or other composition for cleansing of articles in basket 70.

An agitation element 116, such as a vane agitator, impeller, auger, or oscillatory basket mechanism, or some combination thereof is disposed in basket 70 to impart an oscillatory motion to articles and liquid in basket 70. In various example embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about a vertical axis 118.

Basket 70 and agitator 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148 and may be a component of sub-washer unit 65.

Sub-washer unit 65 further includes a vibration damping suspension system or mount 92 for supporting sub-washer unit 65 within apron 52. One end of mount 92 may be connected to sub-washer unit 65 while an opposite end of mount 92 is receivable within and/or coupled to at least one bracket 98. Thus, mount 92 may extend between sub-washer unit 65 and bracket 98 in order to suspend sub-washer unit 65 within apron 52.

Mount 92 may include a plurality of damping elements, such as piston-cylinder damping elements, coupled to the wash tub 64. The damping suspension system, mount 92, may include other elements, such as a balance ring 94 disposed around the upper circumferential surface of the wash basket 70. The balance ring 94 may be used to counterbalance an out of balance condition for the wash machine as the basket 70 rotates within the wash tub 64.

In an illustrative embodiment, laundry items are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise and counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry items are then rinsed, and portions of the cycle may be repeated, including the agitation phase, depending on the particulars of the wash cycle selected by a user.

FIG. 3 is schematic view of certain components of washing machine appliance 50. As may be seen in FIG. 3, washing machine appliance 50 includes a wash fluid height sensor 124, a controller 200 and a wiring harness 220. Controller 200 is positioned within apron 52, e.g., within backsplash 56. Wiring harness 220 electrically connects controller 200 with one or more electrical components, such as motor 76, motor 120 and wash fluid height sensor 124. Thus, e.g., wiring harness 220 may extend between controller 200 and the one or more electrical components.

Referring again to FIG. 1, washing machine appliance 50 may include control panel 58 that may represent a general-purpose Input/Output ("GPIO") device or functional block for washing machine appliance 50. In some embodiments, control panel 58 may include or be in operative communication with one or more input selectors 60, such as one or more of a variety of digital, analog, electrical, mechanical, or electro-mechanical input devices including rotary dials, control knobs, push buttons, toggle switches, selector switches, and touch pads. Additionally, washing machine appliance 50 may include display 61, such as a digital or analog display device generally configured to provide visual feedback regarding the operation of washing machine appliance 50. For example, display 61 may be provided on control panel 58 and may include one or more status lights, screens, or visible indicators. According to example embodiments, input selectors 60 and display 61 may be integrated into a single device, e.g., including one or more of a touchscreen interface, a capacitive touch panel, a liquid crystal display (LCD), a plasma display panel (PDP), or other informational or interactive displays.

Washing machine appliance 50 may further include or be in operative communication with a processing device or controller 200 that may be generally configured to facilitate appliance operation. In this regard, control panel 58, input selectors 60, and display 61 may be in communication with controller 200 such that controller 200 may receive control inputs from input selectors 60, may display information using display 61, and may otherwise regulate operation of washing machine appliance 50. For example, signals generated by controller 200 may operate washing machine appliance 50, including any or all system components, subsystems, or interconnected devices, in response to the position of input selectors 60 and other control commands. Control panel 58 and other components of washing machine appliance 50 may be in communication with controller 200 via, for example, one or more signal lines or shared communication buses. In this manner, Input/Output ("I/O") signals may be routed between controller 200 and various operational components of washing machine appliance 50.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 200 may be constructed without using a microprocessor, e.g., using a combination of discrete analog or digital logic circuitry (such as switches, amplifiers, integrators, comparators, flip-flops, OR gates, and the like) to perform control functionality instead of relying upon software.

Controller 200 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices may store information or data accessible by one or more processors, including instructions that may be executed by the one or more processors. It should be appreciated that the instructions may be software written in any suitable programming language or may be implemented in hardware. Additionally, or alternatively, the instructions may be executed logically or virtually using separate threads on one or more processors.

For example, controller 200 may be operable to execute programming instructions or micro-control code associated with an operating cycle of washing machine appliance 50. In this regard, the instructions may be software or any set of instructions that when executed by the processing device, cause the processing device to perform operations, such as running one or more software applications, displaying a user interface, receiving user input, processing user input, etc. Moreover, it should be noted that controller 200 as disclosed herein is capable of and may be operable to perform any methods, method steps, or portions of methods as disclosed herein. For example, in some embodiments, methods disclosed herein may be embodied in programming instructions stored in the memory and executed by controller 200.

The memory devices may also store data that may be retrieved, manipulated, created, or stored by one or more processors or portions of controller 200. The data may include, for instance, data to facilitate performance of methods described herein. The data may be stored locally (e.g., on controller 200) in one or more databases or may be split up so that the data is stored in multiple locations. In addition, or alternatively, one or more database(s) may be connected to controller 200 through any suitable network(s), such as through a high bandwidth local area network (LAN) or wide area network (WAN). In this regard, for example, controller 200 may further include a communication module or interface that may be used to communicate with one or more other component(s) of washing machine appliance 50, controller 200, an external device 182 (e.g., device controller 188), or any other suitable device, e.g., via any suitable communication lines or network(s) and using any suitable communication protocol. The communication interface may include any suitable components for interfacing with one or more network(s), including for example, transmitters, receivers, ports, controllers, antennas, or other suitable components.

Referring again to FIG. 1, a schematic diagram of an external communication system 180 will be described according to an example embodiment of the present subject matter. In general, external communication system 180 is configured for permitting interaction, data transfer, and other communications between washing machine appliance 50 and one or more remote external devices. For example, this communication may be used to provide and receive operating parameters, user instructions or notifications, performance characteristics, user preferences, or any other suitable information for improved performance of washing machine appliance 50. In addition, it should be appreciated that external communication system 180 may be used to transfer data or other information to improve performance of one or more external devices or appliances or improve user interaction with such devices.

For example, external communication system 180 permits controller 200 of washing machine appliance 50 to communicate with a separate device external to washing machine appliance 50, referred to generally herein as a remote or external device 182. As described in more detail below, these communications may be facilitated using a wired or wireless connection, such as via a network 184. In general, external device 182 may be any suitable device separate from washing machine appliance 50 that is configured to provide or receive communications, information, data, or commands from a user. In this regard, external device 182 may be, for example, a personal phone, a smartphone, a tablet, a laptop or personal computer, a wearable device, a smart home system, or another mobile or remote device. In turn, external device 182 may include a monitor or screen 190 configured to display digital two-dimensional images, as would be understood.

Generally, external device 182 may include a controller 188 (e.g., including one or more suitable processing devices, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. Controller 188 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor of controller 188 or may be included onboard within such processor. In addition, these memory devices may store information or data accessible by the one or more processors of the controller 188, including instructions that may be executed by the one or more processors. It should be appreciated that the instructions may be software written in any suitable programming language or may be implemented in hardware. Additionally, or alternatively, the instructions may be executed logically or virtually using separate threads on one or more processors.

For example, controller 188 may be operable to execute programming instructions or micro-control code associated with operation of or engagement with washing machine appliance 50. In this regard, the instructions may be software or any set of instructions that when executed by the processing device, cause the processing device to perform operations, such as running one or more software applications, displaying, or directing a user interface, receiving user input, processing user input, etc. Moreover, it should be noted that controller 188 as disclosed herein is capable of and may be operable to perform one or more methods, method steps, or portions of methods of appliance operation. For example, in some embodiments, these methods may be embodied in programming instructions stored in the memory and executed by controller 188.

The memory devices of controller 188 may also store data that may be retrieved, manipulated, created, or stored by one or more processors or portions of controller 200. The data may include, for instance, data to facilitate performance of methods described herein. Stored data may be retrieved, manipulated, created, or stored by one or more processors or portions of controller 188. The data may include, for instance, data to facilitate performance of methods described herein.

Returning generally to FIG. 1, the data of controller 188 may be stored locally (e.g., on controller 188) in one or more databases or may be split up so that the data is stored in multiple locations. In addition, or alternatively, one or more database(s) may be connected to controller 188 through any suitable network(s), such as through a high bandwidth local area network (LAN) or wide area network (WAN). In this regard, for example, controller 188 may further include a communication module or interface that may be used to communicate with washing machine appliance 50, controller 200, or any other suitable device, e.g., via any suitable communication lines or network(s) and using any suitable communication protocol. The communication interface may include any suitable components for interfacing with one or more network(s), including for example, transmitters, receivers, ports, controllers, antennas, or other suitable components.

Separate from or in addition to external device 182, a remote server 186 may be in communication with washing machine appliance 50 or external device 182 through network 184. In this regard, for example, remote server 186 may be a cloud-based server 186, and is thus located at a distant location, such as in a separate state, country, etc. According to an example embodiment, external device 182 may communicate with a remote server 186 over network 184, such as the Internet, to transmit/receive data or information, provide user inputs, receive user notifications or instructions, interact with or control washing machine appliance 50, etc. In addition, external device 182 and remote server 186 may communicate with washing machine appliance 50 to communicate similar information.

In general, communication between washing machine appliance 50, external device 182, remote server 186, or other user devices or appliances may be carried using any type of wired or wireless connection and using any suitable type of communication network, non-limiting examples of which are provided below. For example, external device 182 may be in direct or indirect communication with washing machine appliance 50 through any suitable wired or wireless communication connections or interfaces, such as network 184. For example, network 184 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), or protection schemes (e.g., VPN, secure HTTP, SSL).

External communication system 180 is described herein according to an example embodiment of the present subject matter. However, it should be appreciated that the example functions and configurations of external communication system 180 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Controller 200 may be configured for measuring a voltage through motor 120. For example, controller 200 may be in electrical communication with an electrical supply line 127 for measuring the voltage through motor 120. Thus, controller 200 may receive a signal from electrical supply line 127 that corresponds to a line voltage and/or a line stiffness of the electrical supply line 127.

Wash fluid height sensor 124 is operable to measure the height of wash fluid within tub 64. For example, wash fluid height sensor 124 may be fluidly coupled with tub 64 via a hose 125 that extends between tub 64 and wash fluid height sensor 124. A pressure of air within hose 125 may vary as a function of the height of wash fluid within tub 64, and wash fluid height sensor 124 may be configured for measuring the pressure of air within hose 125. Thus, wash fluid height sensor 124 may be a pressure sensor, and a signal from wash fluid height sensor 124 may vary as a function of the height of wash fluid within tub 64. Controller 200 may receive the signal from wash fluid height sensor 124 to establish the height of wash fluid within tub 64.

Controller 200 may be further configured for monitoring a temperature through a temperature sensor 129 positioned at the tub 64 of the washing machine appliance 50. The temperature monitored by controller 200 may generally be an ambient air temperature of washing machine appliance 50. For example, in the present example embodiment, the ambient air temperature of washing machine appliance 50 may be generally used in a fill cycle calibration to improve target fill temperatures during a fill cycle by altering hot or cold fill amounts. The fill cycle calibration will be discussed in further detail hereinbelow.

Drain hose 86 of washing machine appliance 50 may extend through rear panel mounted bracket 49, and an end of drain hose 86 may be received within a drain standpipe 51. Thus, wash fluid from pump assembly 72 may flow through drain hose 86 into drain standpipe 51. Drain standpipe 51 is a component of a building housing washing machine appliance 50. Thus, a height HS of drain standpipe 51 may vary between buildings. The height HS of drain standpipe 51 may correspond to a vertical distance between a bottom of washing machine appliance 50 (e.g., or rear panel mounted bracket 49) and a top of drain standpipe 51 (e.g., at which drain hose 86 is inserted into drain standpipe 51).

In general, controller 200 may be configured to operate a calibration cycle, which may include several individual calibration cycles, such as a dry calibration cycle (dry as in "without water," not a "drying" cycle meant to remove water), the fill calibration cycle, and a drain calibration cycle. Moreover, controller 200 may be generally configured to perform a series of operations of the various calibration cycles, such as measuring, analyzing, monitoring, identifying, updating, and performing, as will be described herein.

Referring particularly to the dry calibration cycle, in example embodiments, the dry calibration cycle may be used with a washing machine appliance, such as a washing machine appliance which includes controller 200 in operative communication with the motor 120, the electrical supply line 127, and the temperature sensor 129. Controller 200 may be generally configured to receive an activation signal of the calibration cycle. For example, the activation signal may include an input on user interface, e.g., control panel 58 and input selectors 60 of washing machine appliance 50. Controller 200 may also be generally configured to analyze a cycle history of washing machine appliance 50. The cycle history may be stored on a memory of controller 200 and may indicate that a cycle was conducted within a set time, such as within an hour of receiving the activation signal of the calibration cycle.

Furthermore, in the dry calibration cycle, controller 200 may be generally configured to measure a first line voltage of electrical supply line 127. In the present example embodiment, measuring the first line voltage includes determining whether the washing machine appliance 50 is receiving one of a low voltage, an expected voltage, or a high voltage from electrical supply line 127. In particular, the low voltage value may be less than one-hundred and ten volts (110 v), the expected voltage value may be about one-hundred and twenty volts (120 v), and the high voltage value may be greater than one-hundred and thirty volts (130 v). Further, measuring the first line voltage of electrical supply line 127 may include having no (zero) load applied to electrical supply line 127.

Moreover, in the dry calibration cycle, controller 200 may be generally configured to monitor the temperature via temperature sensor 129 of washing machine appliance 50. As stated above, the temperature monitored by controller 200 may generally be an ambient air temperature of washing machine appliance 50. In the scenario where the cycle history indicates a cycle was run within the set time, the temperature monitored by controller 200 may be a distorted temperature reading. As such, the distorted temperature reading may be discarded from or ignored in later steps of the calibration cycle. In general, monitoring the temperature via temperature sensor 129 of washing machine appliance 50 may advantageously aid in improving the accuracy of the temperature during the fill cycle of washing machine appliance 50, and as such may increase the fluid efficiency of washing machine appliance 50.

Referring still to the dry calibration cycle, controller 200 may be generally configured to measure a load inertia and a second line voltage of electrical supply line 127. In general, the measuring of the load inertia may include spinning basket 70 of washing machine appliance 50, while basket 70 is empty, e.g., basket 70 contains no articles for washing nor any fluid during the measuring of the load inertia. Moreover, measuring the second line voltage of electrical supply line 127 may include a load applied to electrical supply line 127, such as measuring the second line voltage while powering motor 120 to spin basket 70. Furthermore, calculating a line stiffness of electrical supply line 127 may include determining the variation in voltage over time, e.g., the first line voltage to the second line voltage, through electrical supply line 127. In general, measuring the first line voltage, second line voltage, and calculating the line stiffness of electrical supply line 127 may advantageously aid in increasing electrical efficiency by improving the operation of washing machine appliance 50 in varying voltage situations.

Thus, in the dry calibration cycle, controller 200 may be generally configured to update operational parameters of washing machine appliance 50 in response to one or more of a line stiffness between the first line voltage and the second line voltage, the load inertia, and/or the temperature. However, as stated above, when the temperature monitored by controller 200 is a distorted temperature reading, updating the operational parameters may be in response to one or more of the line voltage, the first and second line stiffness, and the load inertia. In general, updating the operational parameters may be directed towards improving the operation of washing machine appliance 50 in low or high voltage conditions, improving load sensing accuracy, and/or improving fill temperature accuracy from the ambient temperature. After updating the operational parameters, controller 200 may be generally configured to perform an operation cycle, such as a washing cycle, of washing machine appliance 50 with the updated operational parameters. Such updated operational parameter may provide improved operation of the washing machine appliance, such as improving washer function in low or high voltage conditions, improving load sensing accuracy, and improving fill temperatures accuracy from the temperature information.

In some example embodiments, controller 200 may be further configured to provide a user notification in response to the voltage being one of below a predetermined low threshold or above a predetermined high threshold. For example, if the voltage is less than the predetermined low voltage threshold of eighty volts (80 v) or the voltage is greater than the predetermined high voltage threshold of one-hundred and sixty volts (160 v), controller 200 may provide a user notification to a user of the washing machine appliance 50.

Referring now particularly to the fill calibration cycle, in example embodiments, the fill calibration cycle includes controller 200 in operative communication with pump assembly 72, a hot water valve 102, and a cold water valve 104. Controller 200 may be generally configured to receive an activation signal of the calibration cycle. For example, the activation signal may include an input on user interface, e.g., control panel 58 and input selectors 60 of washing machine appliance 50. Controller 200 may also be generally configured to initialize a fill sequence of the washing machine appliance 50. The fill sequence may generally include flowing a first volume of water into tub 64 of the washing machine appliance 50. Flowing the first volume of water may be stopped upon reaching a first predetermined pressure threshold. The fill sequence of the washing machine appliance 50 may further include flowing a second volume of water into tub 64 of the washing machine appliance 50. Flowing the second volume of water may be stopped upon reaching a second predetermined pressure threshold. At this point, controller 200 may be configured to record one or more of a fill time of the second volume of water and a temperature of the second volume of water in the memory of controller 200. Then, the fill sequence may further include flowing a third volume of water into tub 64 of the washing machine appliance 50. Flowing the third volume of water may be stopped upon reaching a third predetermined pressure threshold. At this point, controller 200 may be configured to record one or more of a fill time of the third volume of water and a temperature of the third volume of water in the memory of controller 200. In some example embodiments, the first volume of water may be flowed from the cold water supply valve 104, the second volume of water may also be flowed from the cold water supply valve 104, and the third volume of water may be flowed from the hot water supply valve 102. In general, recording the fill time and temperature after flowing the second and third volumes of water may advantageously aid in improving the accuracy of the temperature and the fill volume during the fill cycle of washing machine appliance 50, and as such may increase the fluid efficiency of washing machine appliance 50.

Moreover, in the fill calibration cycle, controller 200 may be generally configured to determine a supply connection orientation of a hot water supply hose 106 and a cold water supply hose 108. For example, the determining of the supply connection orientation of the hot water supply hose 106 and the cold water supply hose 108 includes comparing temperatures of water flowing from each of the hot water supply valve 102 and the cold water supply valve 104. In some example embodiments, in response to the determining of the supply connection orientation, the controller may be further configured to switch operation of the hot water supply valve 102 and the cold water supply valve 104, e.g., if the determination is made that the supply hose connections of the hot water supply hose 106 and the cold water supply hose 108 are reversed, the controller 200 may switch operation of the respective hot water supply valve 102 and the cold water supply valve 104. Additionally, controller 200 may be generally configured to measure a volume of water from the hot water supply valve 102 before reaching a predetermined temperature threshold, such as while flowing the third volume of water. Further, controller 200 may be generally configured to measure flow rates of water from the hot water supply valve 102 and the cold water supply valve 104, such as while flowing the first, or second, and third volume of water. In general, determining the supply connection orientation and switching operation of the respective hot water supply valve 102 and the cold water supply valve 104 may advantageously aid the user by correcting the issue, without the user spending time and/or money to fix the washing machine appliance 50.

Thus, in the fill calibration cycle, controller 200 may be generally configured to update operational parameters of washing machine appliance 50 in response to one or more of the supply connection orientation, the volume of water from the hot water supply valve 102 before reaching the predetermined temperature threshold, and flow rates of water from the hot water supply valve 102 and the cold water supply valve 104. After updating the operational parameters, controller 200 may be generally configured to perform an operation cycle, such as a washing cycle, of washing machine appliance 50 with the updated operational parameters. Such updated operational parameter may provide improved operation of the washing machine appliance, such as improving water fill temperature accuracy, improving water fill volume accuracy, and save technician and/or user work by correcting the valve usage.

Referring now particularly to the drain calibration cycle, in example embodiments, the drain calibration cycle includes controller 200 in operative communication with pump assembly 72 and pressure sensor 124. Controller 200 may be generally configured to receive an activation signal of the calibration cycle. For example, the activation signal may include an input on user interface, e.g., control panel 58 and input selectors 60 of washing machine appliance 50. Controller 200 may also be generally configured to initialize a drain sequence of the washing machine appliance 50. The drain sequence may generally include draining a first volume of water to a predetermined pressure threshold measured by the pressure sensor 124. Draining the first volume of water may be stopped upon reaching the predetermined pressure threshold. Controller 200 may be further configured to record a drain time after draining the first volume of water reaches the predetermined pressure threshold. The drain time may be the time it takes for the first volume of water to drain to the predetermined pressure threshold. Furthermore, the drain sequence of the washing machine appliance 50 may include monitoring a pressure within tub 64 with the pressure sensor 124 after draining the first volume of water reaches the predetermined pressure threshold. Additionally, the drain sequence of the washing machine appliance 50 may include draining a second volume of water to remove remaining water from the washing machine appliance 50. While described with respect to draining a first volume of water and a second volume of water, it should be appreciated that the present disclosure may include more than two volumes of water throughout the drain sequence, such as the present disclosure may include draining a third volume of water, or draining a fourth volume of water, etc.

Moreover, in the drain calibration cycle, controller 200 may be further configured to measure a flow rate of water through drain hose 86 during the drain sequence. For example, the flow rate of the water may be calculated with one or more of pressure levels both before and after draining the first volume of water, and the drain time. Additionally, controller 200 may be generally configured to identify a siphoning pull through the drain hose 86. For example, identifying the siphoning pull through drain hose 86 may include detecting pressure drop, e.g., continued pressure drops, after draining the first volume of water reaches the predetermined pressure threshold. Additionally, in some situations, it is possible for the siphoning pull to occur both into and out of tub 64.

Furthermore, in the drain calibration cycle, controller 200 may be generally configured to measure a volume of water backflowing from drain hose 86. In particular, drain hose 86 may be fluidly coupled with drain standpipe 51, whereby the drain sequence may generally include flowing wash liquid from tub 64 via drain hose 86 and the drain standpipe 51. As such, a height of the drain standpipe may be determined based on the volume of water backflowing into the washing machine appliance 50 from drain hose 86.

Thus, in the drain calibration cycle, controller 200 may be generally configured to update operational parameters of washing machine appliance 50 in response to one or more of the flow rate through drain hose 86, the identification of the siphoning pull, and the volume of water backflowing from drain hose 86. After updating the operational parameters, controller 200 may be generally configured to perform an operation cycle, such as a washing cycle, of washing machine appliance 50 with the updated operational parameters. In general, the drain calibration cycle may advantageously aid in detecting the drain hose siphoning phenomenon, drain blockages, and/or standpipe height impacts, such that the updated operational parameters may provide improved operation of the washing machine appliance in the operation cycle, such as improved, e.g., faster, and more efficient, drain operation.

Now that the construction of washing machine appliance 50 and the configuration of controller 200 according to example embodiments have been presented, example methods (e.g., methods 400, 500, and 600) of operating a washing machine appliance will be described. Although the discussion below refers to the example methods 400, 500, and 600 of operating washing machine appliance 50, one skilled in the art will appreciate that the example methods 400, 500, and 600 are applicable to the operation of a variety of other washing machine appliances, such as horizontal axis washing machine appliances or combination appliances. In example embodiments, the various method steps as disclosed herein may be performed (e.g., in whole or part) by controller 188, controller 200, or another, separate, dedicated controller.

Figure 4:
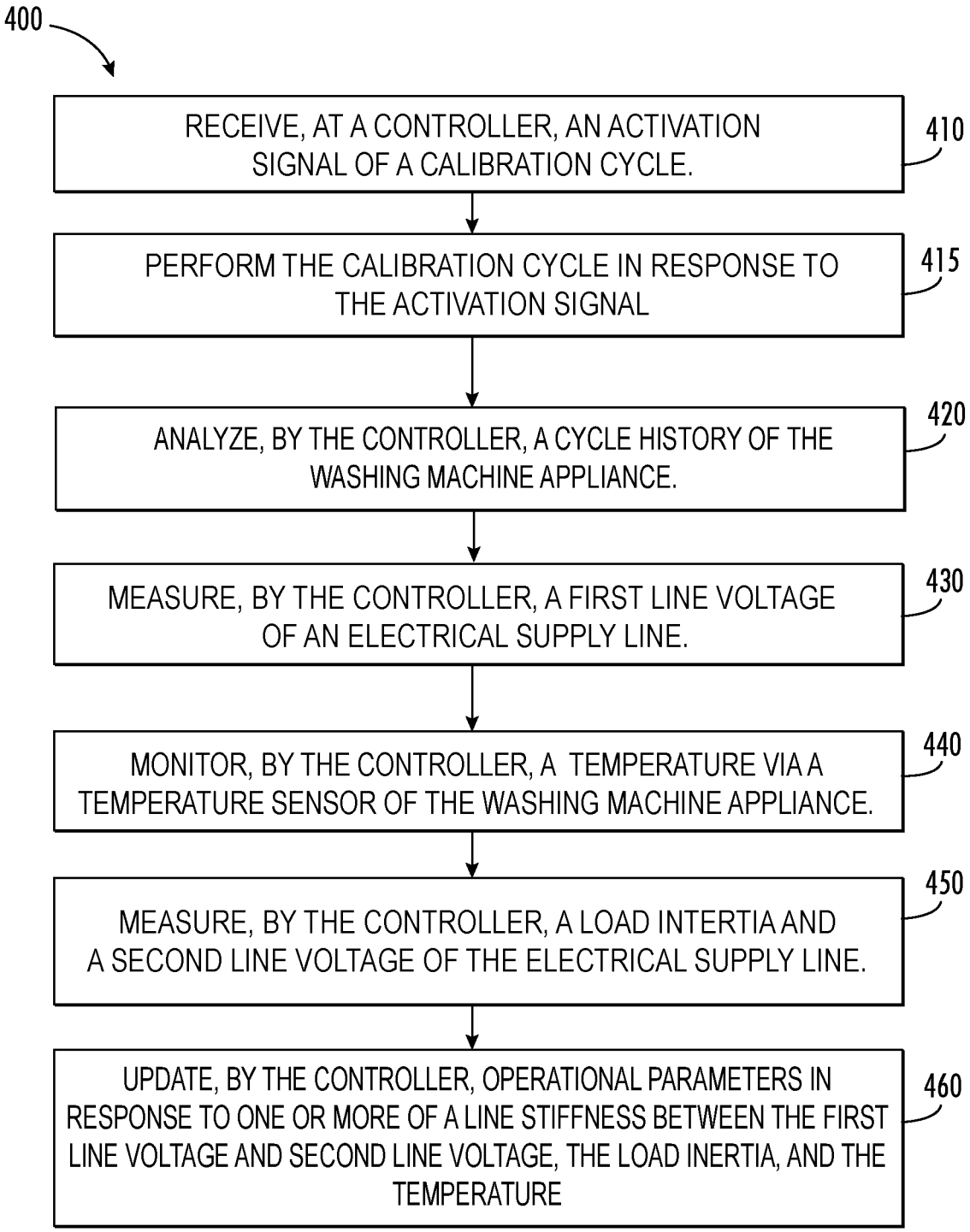
FIG. 4 is a flowchart of a method of calibrating a dry cycle of the washing machine appliance according to aspects of the subject matter.
Figure 5:
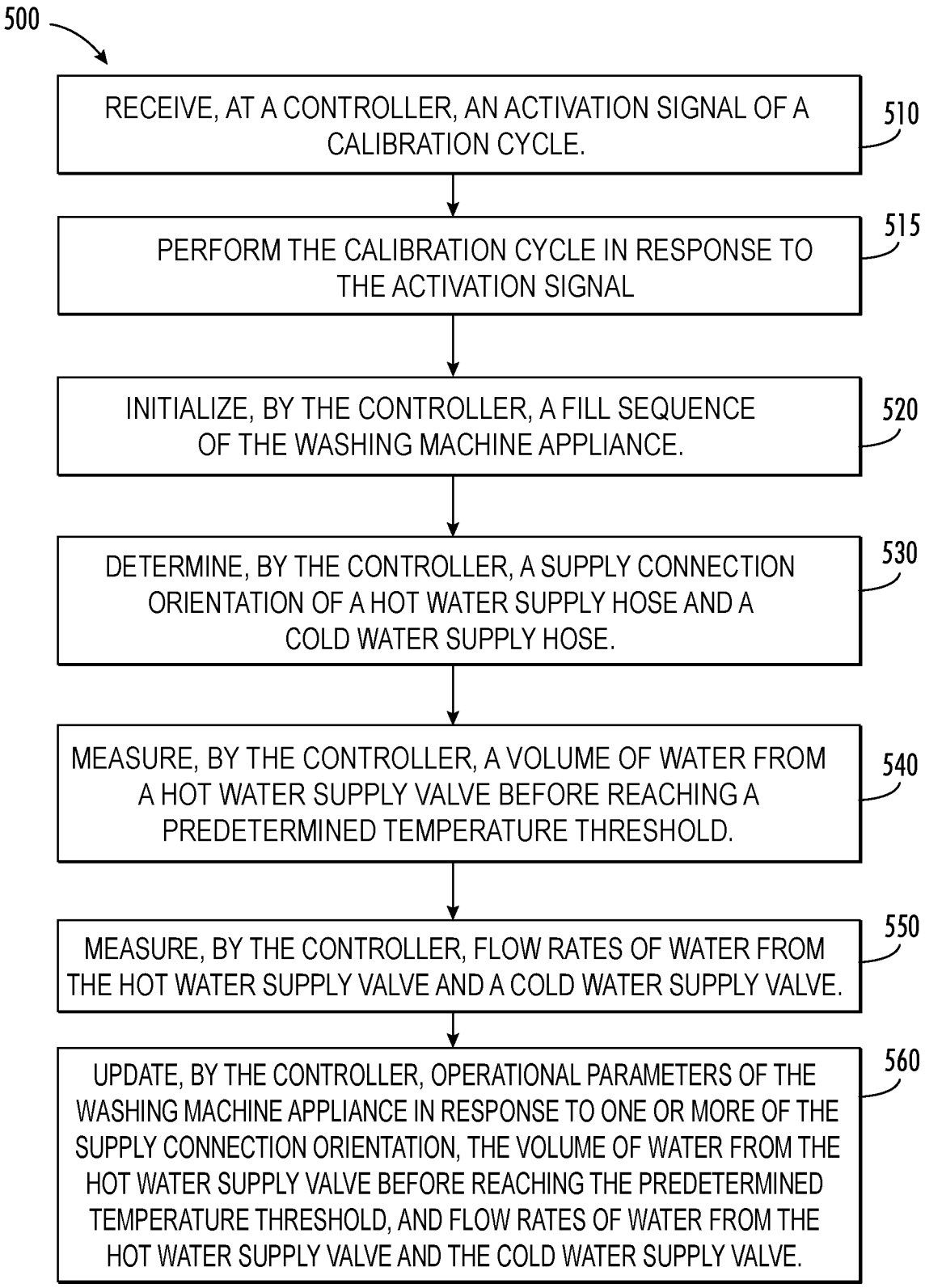
FIG. 5 is a flowchart of a method of calibrating a fill cycle of the washing machine appliance according to aspects of the subject matter.
Figure 6:
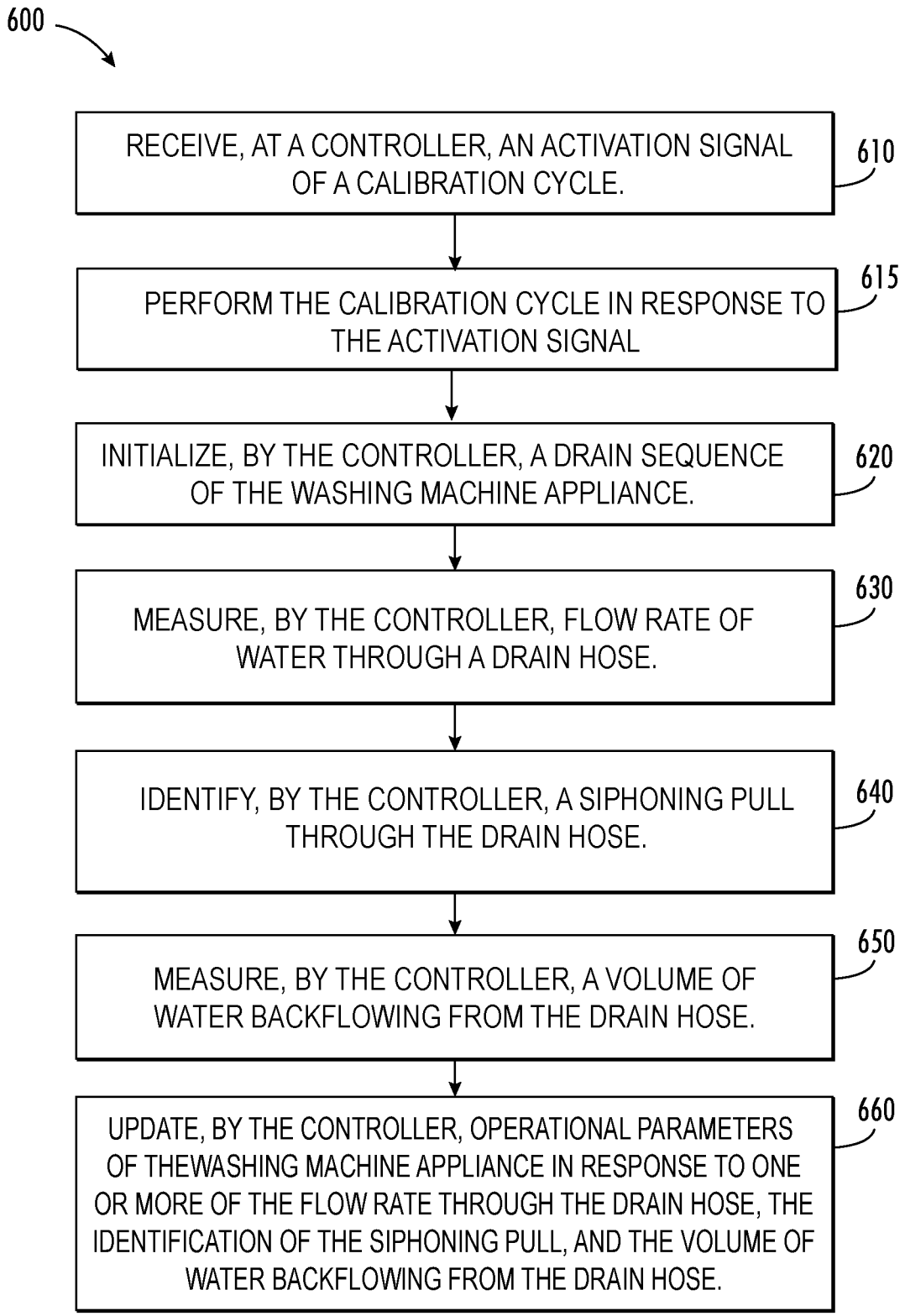
FIG. 6 is a flowchart of a method of calibrating a drain cycle of the washing machine appliance according to aspects of the subject matter.

FIGS. 4, 5, and 6 depict steps performed in a particular order for the purpose of illustration and discussion. Those of ordinary skill in the art, using the disclosures provided herein, will understand that (except as otherwise indicated) methods 400, 500, and 600 are not mutually exclusive. Moreover, the steps of the methods 400, 500, and 600 can be modified, adapted, rearranged, omitted, interchanged, or expanded in various ways without deviating from the scope of the present disclosure.

Referring now to FIG. 4, at (410), method 400 may generally include receiving, at a controller, such as controller 200, an activation signal of a calibration cycle. And, at (415), method 400 may generally include performing the calibration cycle in response to receiving the activation signal.

At (420), the calibration cycle of method 400 may generally include analyzing, by the controller, a cycle history of a washing machine appliance, such as washing machine appliance 50.

At (430), the calibration cycle of method 400 may generally include measuring, by the controller, a first line voltage of an electrical supply line, such as electrical supply line 127.

At (440), the calibration cycle of method 400 may generally include monitoring, by the controller, a temperature via a temperature sensor, such as temperature sensor 129 of the washing machine appliance 50.

At (450), the calibration cycle of method 400 may generally include measuring, by the controller, a load inertia and a second line voltage of the electrical supply line.

At (460), the calibration cycle of method 400 may generally include updating, by the controller, operational parameters in response to one or more of a line stiffness between the first line voltage and the second line voltage, the load inertia, and the temperature.

In some example embodiments, the calibration cycle of method 400 may generally include performing an operation cycle of the washing machine appliance with the updated operational parameters.

Additionally, in some example embodiments, the calibration cycle of method 400 may generally include providing a user notification in response to the voltage one of below a predetermined low threshold or above a predetermined high threshold.

Referring now to FIG. 5, at (510), method 500 may generally include receiving, at a controller, such as controller 200, an activation signal of a calibration cycle. And, at (515), method 500 may generally include performing the calibration cycle in response to receiving the activation signal.

At (520), the calibration cycle of method 500 may generally include initializing, by the controller, a fill sequence of the washing machine appliance, such as washing machine appliance 50.

At (530), the calibration cycle of method 500 may generally include determining, by the controller, a supply connection orientation of a hot water supply hose and a cold water supply hose, such as hot water supply hose 106 and cold water supply hose 108.

At (540), the calibration cycle of method 500 may generally include measuring, by the controller, a volume of water from a hot water supply valve, e.g., hot water supply valve 102, before reaching a predetermined temperature threshold.

At (550), the calibration cycle of method 500 may generally include measuring, by the controller, flow rates of water from the hot water supply valve and a cold water supply valve, e.g., cold water supply valve 104.

At (560), the calibration cycle of method 500 may generally include updating, by the controller, operational parameters of the washing machine appliance 50 in response to one or more of the supply connection orientation, the volume of water from the hot water supply valve before reaching the predetermined temperature threshold, and flow rates of water from the hot water supply valve and the cold water supply valve.

In some example embodiments, the calibration cycle of method 500 may generally include performing an operation cycle of the washing machine appliance with the updated operational parameters.

Referring now to FIG. 6, at (610), method 600 may generally include receiving, at a controller, such as controller 200, an activation signal of a calibration cycle. And, at (615), method 600 may generally include performing the calibration cycle in response to receiving the activation signal.

At (620), the calibration cycle of method 600 may generally include initializing, by the controller, a drain sequence of a washing machine appliance, such as washing machine appliance 50.

At (630), the calibration cycle of method 600 may generally include measuring, by the controller, a flow rate of water through a drain hose, such as drain hose 86, during the drain sequence.

At (640), the calibration cycle of method 600 may generally include identifying, by the controller, a siphoning pull through the drain hose.

At (650), the calibration cycle of method 600 may generally include measuring, by the controller, a volume of water backflowing from the drain hose.

At (660), the calibration cycle of method 600 may generally include updating, by the controller, operational parameters of the washing machine appliance 50 in response to one or more of the flow rate through the drain hose, the identification of the siphoning pull, and the volume of water backflowing from the drain hose.

In some example embodiments, the calibration cycle of method 600 may generally include performing an operation cycle of the washing machine appliance with the updated operational parameters.

As may be seen from the above, a controller of a washing machine appliance may be configured to operate a calibration cycle, which may include several individual calibration cycles, such as a dry calibration cycle, a fill calibration cycle, and a drain calibration cycle. The controller may be generally configured to operate a series of steps of the various calibration cycles, such as measuring, analyzing, determining, monitoring, identifying, updating, and performing. As such the calibration cycles may advantageously improve the operation of the washing machine appliance by advantageously increasing electrical efficiency, fluid efficiency, cycle time efficiency and the detection of faults with the washing machine appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for a dry cycle calibration in a washing machine appliance, the washing machine appliance comprising a tub, a basket within the tub, a motor coupled to the basket, the motor operable to rotate the basket within the tub, an electrical supply line in electrical communication with the motor, a temperature sensor positioned at the tub, and a controller in operative communication with the motor, the electrical supply line, and the temperature sensor, the method comprising:

receiving, at the controller, an activation signal of a calibration cycle;

performing, by the controller, the calibration cycle in response to the activation signal, the calibration cycle comprising:

analyzing, by the controller, a cycle history of the washing machine appliance;

measuring, by the controller, a first line voltage of the electrical supply line;

monitoring, by the controller, a temperature via the temperature sensor of the washing machine appliance;

measuring, by the controller, a load inertia and a second line voltage of the electrical supply line; and updating, by the controller, operational parameters in response to each of a line stiffness between the first line voltage and the second line voltage, the load inertia, and the temperature, wherein the cycle history indicates a cycle was conducted within a set time of receiving the activation signal of the calibration cycle, the method further comprising:

determining, by the controller, the temperature monitored by the controller is a distorted temperature reading based on the cycle conducted within the set time of receiving the activation signal; and updating, by the controller, the operational parameters is in response to each of the line stiffness between the first line voltage and the second line voltage, and the load inertia.

2. The method of claim 1, wherein the cycle history of the washing machine appliance is stored on a memory of the controller.

3. The method of claim 1, wherein the activation signal comprises one of an input on a user interface of the washing machine appliance or an input from an external device.

4. The method of claim 1, wherein no load is applied to the electrical supply line when the first line voltage of the electrical supply line is measured by the controller.

5. The method of claim 1, wherein a load is applied to the electrical supply line when the second line voltage of the electrical supply line is measured by the controller.

6. The method of claim 1, wherein the temperature monitored by the controller is an ambient air temperature of the washing machine appliance.

7. The method of claim 1, wherein measuring the load inertia comprises spinning a basket of the washing machine appliance, while the basket is empty.

8. The method of claim 1, wherein measuring the first line voltage and second line voltage comprises determining whether the washing machine appliance is receiving one of a low voltage, an expected voltage, or a high voltage from the electrical supply line.

9. The method of claim 8, wherein the low voltage is below a predetermined low threshold and the high voltage is above a predetermined high threshold, further comprising providing a user notification in response to determining the washing machine appliance is receiving one of the low voltage or the high voltage.

10. A washing machine appliance, comprising:

a tub;

a basket within the tub;

a motor coupled to the basket, the motor operable to rotate the basket within the tub;

an electrical supply line in electrical communication with the motor;

a temperature sensor positioned at the tub; and a controller in operative communication with the motor, the electrical supply line, and the temperature sensor, the controller configured to perform a dry cycle calibration of the washing machine appliance, the controller configured to:

receive an activation signal of a calibration cycle, perform the calibration cycle in response to the activation signal, wherein, in the calibration cycle the controller is configured to, analyze a cycle history of the washing machine appliance, measure a first line voltage of an electrical supply line, monitor a temperature via the temperature sensor of the washing machine appliance, measure a load inertia and a second line voltage of the electrical supply line, and update operational parameters in response to each of a line stiffness between the first line voltage and the second line voltage, the load inertia, and the temperature, wherein the cycle history indicates a cycle was conducted within a set time of receiving the activation signal of the calibration cycle, the controller further configured for:

determining the temperature monitored by the controller is a distorted temperature reading based on the cycle conducted within the set time of receiving the activation signal; and updating the operational parameters is in response to each of the line stiffness between the first line voltage and the second line voltage, and the load inertia.

11. The washing machine appliance of claim 10, wherein the cycle history of the washing machine appliance is stored on a memory of the controller.

12. The washing machine appliance of claim 10, wherein the activation signal comprises one of an input on a user interface of the washing machine appliance or an input from an external device.

13. The washing machine appliance of claim 10, wherein no load is applied to the electrical supply line when the first line voltage of the electrical supply line is measured by the controller.

14. The washing machine appliance of claim 10, wherein a load is applied to the electrical supply line when the second line voltage of the electrical supply line is measured by the controller.

15. The washing machine appliance of claim 10, wherein the temperature monitored by the controller is an ambient air temperature of the washing machine appliance.

16. The washing machine appliance of claim 10, wherein measuring the load inertia comprises spinning a basket of the washing machine appliance, while the basket is empty.

17. The washing machine appliance of claim 10, wherein measuring the line voltage comprises determining whether the washing machine appliance is receiving one of a low voltage, an expected voltage, or a high voltage from the electrical supply line.

18. The washing machine appliance of claim 10, wherein the low voltage is below a predetermined low threshold and the high voltage is above a predetermined high threshold, wherein the controller is further configured to provide a user notification in response to determining the washing machine appliance is receiving one of the low voltage or the high voltage.

* * * * *